US006704992B2

(12) United States Patent
Minor

(10) Patent No.: US 6,704,992 B2
(45) Date of Patent: Mar. 16, 2004

(54) CABLE PUNCH ASSEMBLY

(75) Inventor: Randolph J. Minor, Stonington, CT (US)

(73) Assignee: Hubbell Incorporated, Orange, CT (US)

( * ) Notice: Subject to any disclaimer, the term of this patent is extended or adjusted under 35 U.S.C. 154(b) by 22 days.

(21) Appl. No.: 10/024,508

(22) Filed: Dec. 21, 2001

(65) Prior Publication Data

US 2003/0115737 A1 Jun. 26, 2003

(51) Int. Cl.[7] ..... H01R 43/00
(52) U.S. Cl. ..... 29/566.4; 33/866
(58) Field of Search ..... 29/33 M, 566.4, 29/566.3, 566.1, 861, 866

(56) References Cited

U.S. PATENT DOCUMENTS

| | | | | | |
|---|---|---|---|---|---|
| 4,161,061 | A | | 7/1979 | Mason et al. | 29/566.4 |
| 4,627,150 | A | * | 12/1986 | Burnett | 29/566.4 |
| 4,797,988 | A | * | 1/1989 | Bowden et al. | 29/566.4 |
| 5,127,152 | A | * | 7/1992 | Meyer | 29/749 |
| 5,358,424 | A | * | 10/1994 | Bowen et al. | 439/395 |
| 5,472,129 | A | * | 12/1995 | Yagawa | 242/615 |
| 5,561,898 | A | * | 10/1996 | White et al. | 29/748 |
| 5,645,444 | A | | 7/1997 | Sahlberg et al. | 439/392 |
| 5,745,975 | A | * | 5/1998 | Heisner et al. | 29/564.6 |
| 5,832,603 | A | | 11/1998 | Fallandy | 29/861 |
| 5,836,069 | A | | 11/1998 | Fallandy et al. | 29/566.4 |
| 5,970,607 | A | * | 10/1999 | Herzog | 29/832 |
| 6,193,526 | B1 | * | 2/2001 | Milner et al. | 439/76.1 |
| 6,247,230 | B1 | | 6/2001 | Hart et al. | 29/866 |
| 6,317,961 | B1 | * | 11/2001 | Yamada | 29/564.2 |
| 6,338,643 | B1 | * | 1/2002 | Miller et al. | 439/417 |

* cited by examiner

*Primary Examiner*—Erica Cadugan
(74) *Attorney, Agent, or Firm*—Marcus R. Mickney; Alfred N. Goodman; Mark S. Bicks

(57) ABSTRACT

A cable punch assembly has a rod with first and second ends, and a base with first and second faces. The second end of the rod is connected to the first face. First and second connectors extend from the second face. Each of the connectors includes two laterally spaced wire pusher members that extend axially from the base to receive an insulation displacement contact between the pusher members as the pusher members force a wire into a wire receiving slot of the contact. Each connector engages a single wire, so the cable punch assembly may connect a plurality of wires to a plurality of insulation displacement contacts of a wiring unit. A blade may be positioned proximal each connector to cut off excess wire at the same time that the wires are inserted into receiving slots of insulation displacement contacts.

12 Claims, 9 Drawing Sheets

CABLE PUNCH ASSEMBLY

FIELD OF THE INVENTION

The present invention relates to a cable punch assembly. More particularly, the present invention relates to cable punch assembly for inserting multiple cables simultaneously. The cable punch assembly inserts up to four pairs of cables into insulation displacement contacts in a wiring unit.

BACKGROUND OF THE INVENTION

Due to significant advancements in telecommunications and data transmission speeds over unshielded twisted pair cables or wires, the connectors (jacks, patch panels, cross connects, etc.) have become critical factors in achieving high performance in data transmission systems, particularly at the higher frequencies. Some performance characteristics, particularly near end crosstalk, can degrade beyond acceptable levels at new, higher frequencies in the connectors unless adequate precautions are taken.

Often, wiring is pre-existing. Standards define the geometry and the pin definitions for the connectors, making any changes to the wiring and to the connector geometry and pin definitions for improving performance characteristics cost prohibitive.

The use of unshielded twisted pair wiring and the establishment of certain standards for connector geometry and pin definitions were created prior to the need for high speed data transmissions. Thus, while using the existing unshielded twisted pair wiring and complying with the existing standards, connectors must be developed that fulfill the performance requirements of today's higher speed communications in order to maintain compatibility with the existing connectors. Typical connectors are disclosed in U.S. Pat. No. 6,193,526 of John J. Milner, Joseph E. Dupuis, Richard A. Fazio, and Robert A. Aekins, issued Feb. 27, 2001 and entitled "Wiring Unit with Angled Insulation Displacement Contacts", and to U.S. patent application Ser. No. 09/675,652 of Alan C. Miller, John J. Milner and Raul G. Pereira, filed Sep. 29, 2000, and entitled "Stuffer Cap Mechanism for an Electrical Connector", the subject matter of each of which is hereby incorporated by reference One problem with attaching the twisted pair wiring to the terminals of a wiring unit for an electrical connector is that only one wire may be attached at a time. Therefore, one wire must be individually attached to a terminal of the wiring unit before a second wire may be attached. This step is repeated for each terminal of the wiring unit. For a typical RJ plug having eight terminals, this process must be performed eight times. Such a process is time consuming and costly.

Another problem is that once an existing cable punch is used to attach a single wire to a terminal, a separate device must be used to cut excess wiring from the wiring unit. For the typical RJ plug having eight terminals, sixteen steps must be performed to connect eight wires in the eight terminals. Eight wires must be connected to the eight terminals, which requires eight separate steps. After each wire connecting step, a second separate step is required to cut off excess wire at each terminal. A sixteen step process to wire a wiring unit is time consuming and costly.

A need exists for a cable punch assembly that efficiently connects a plurality of wires to terminals of a wiring unit and cuts excess wiring from the wiring unit.

SUMMARY OF THE INVENTION

Accordingly, it is a primary objective of the present invention to provide an improved cable punch assembly.

A further objective of the present invention is to provide a cable punch assembly that connects a plurality of wires to plural insulation displacement contacts.

A still further objective of the present invention is to provide a cable punch assembly having blades for cutting excess wire from a wiring unit.

The foregoing objects are basically attained by providing a cable punch assembly for connecting a plurality of wires to plural insulation displacement contacts. The cable punch assembly has a rod having first and second ends, and a base having first and second faces. The second end of the rod is connected to the first face. First and second connectors extend from the second face. Each of the connectors includes two laterally spaced wire pusher members that extend axially from the base to receive an insulation displacement contact between the pusher members as the pusher members force a wire into a wire receiving slot of the contact.

Each pair of the wire pusher members engages a single wire, so the cable punch assembly may connect a plurality of wires to a plurality of insulation displacement contacts of a wiring unit. Connecting a plurality of wires at a time decreases the amount of time required to wire a wiring unit.

Preferably, a blade is positioned proximal each connector allowing a cable punch assembly to cut off excess wire at the same time that the wires are inserted into receiving slots of the contacts, thereby reducing the number of steps and time required to wire a wiring unit.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings that form a part of the original disclosure.

DETAILED DESCRIPTION OF THE INVENTION

Figure 1:
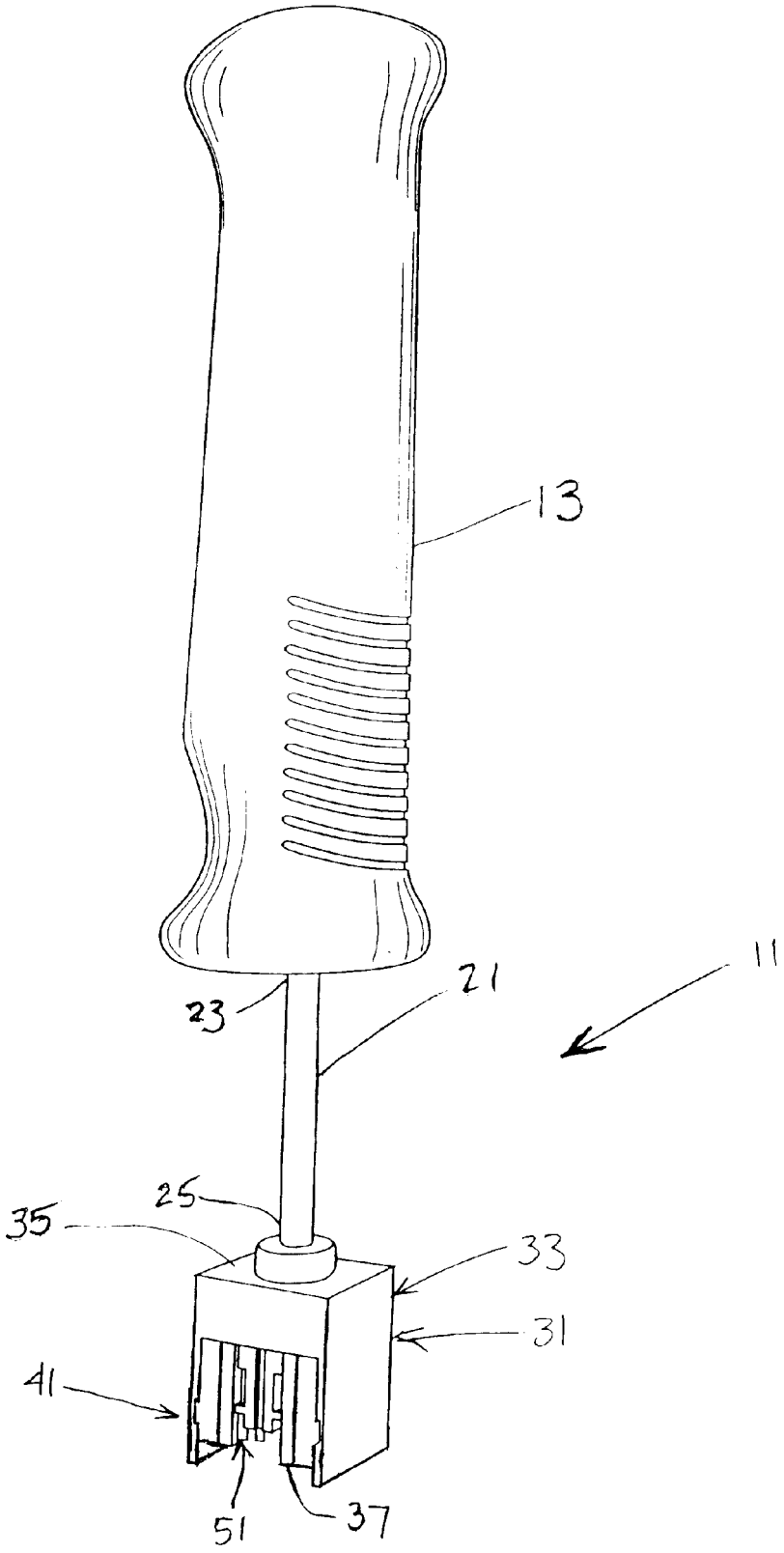
FIG. 1 is a perspective view of a cable punch assembly according to the present invention, showing a front face of the base.

As shown in FIGS. 1–13, the present invention relates to a cable punch assembly 11 for terminating wires at a wiring unit. The cable punch assembly 11 has a handle 13 for wielding the cable punch assembly by a user. A rod 21 has first and second ends 23 and 25, respectively. The first end 23 is connected to the handle 13. A base 31 has first and second faces 35 and 37, respectively. The second end 25 of the rod 21 is connected to base 31 at first face 35. At least two connectors 51 extend from the second face 37 of the base 31.

Figure 2:
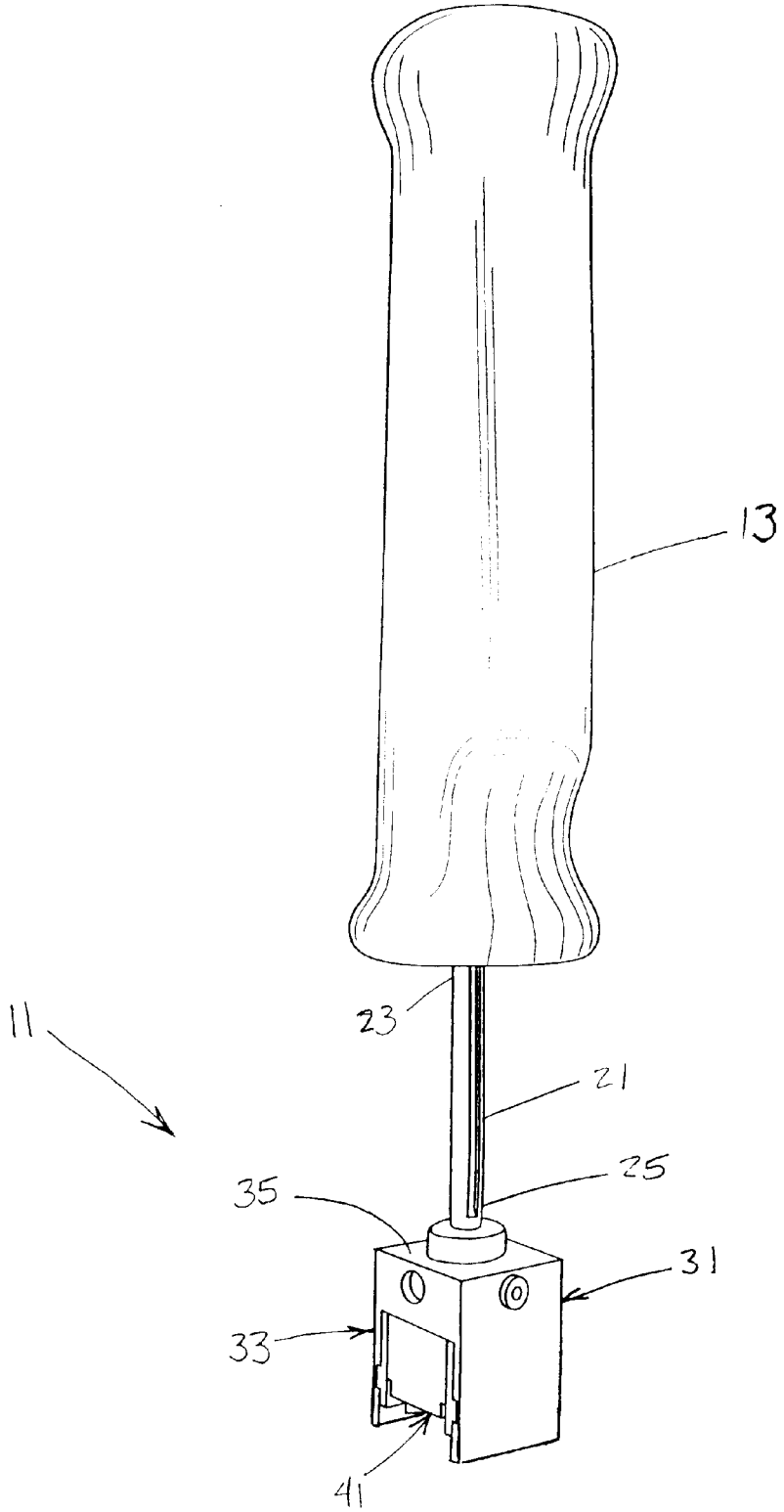
FIG. 2 is a perspective view of the cable punch assembly of FIG. 1, showing a rear face of the base.

As shown in FIGS. 1 and 2, the handle 13 may be of any suitable shape to be wielded by a user. Preferably, the handle is shaped to conform to a user's grip and has a rubber outer layer to facilitate a user's grip.

Figure 13:
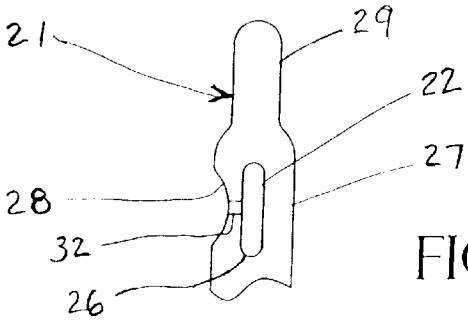
FIG. 13 is a front elevational view of a second end of a rod of the cable punch assembly of FIG. 1.

The rod 21 may be of any suitable shape, but is preferably cylindrical. As shown in FIG. 13, the rod 21 may have first and second portions 27 and 29, respectively. The first portion 27 has a larger diameter than the second portion 29. The first portion 27 has an axial groove 22 that has a first end 24 proximal the transition between the first and second portions of the rod and extends axially along the first portion of the rod to a second end 26. A recess 28 in the rod 21 is located approximately 90 degrees around the circumference of the rod from the axial groove 22. A circumferential groove 32 extends from the axial groove 22 to the recess 28.

Preferably, the base first face 35 is opposite its second face 37. The first face 35 of the base 31 receives the rod 21. Preferably, the base 31 has a body 33 and a removable insert 41 received by the body. Although, the base can have a body 33 and an insert 41 that are separately formed and assembled, the base may be a single piece.

Figure 5:
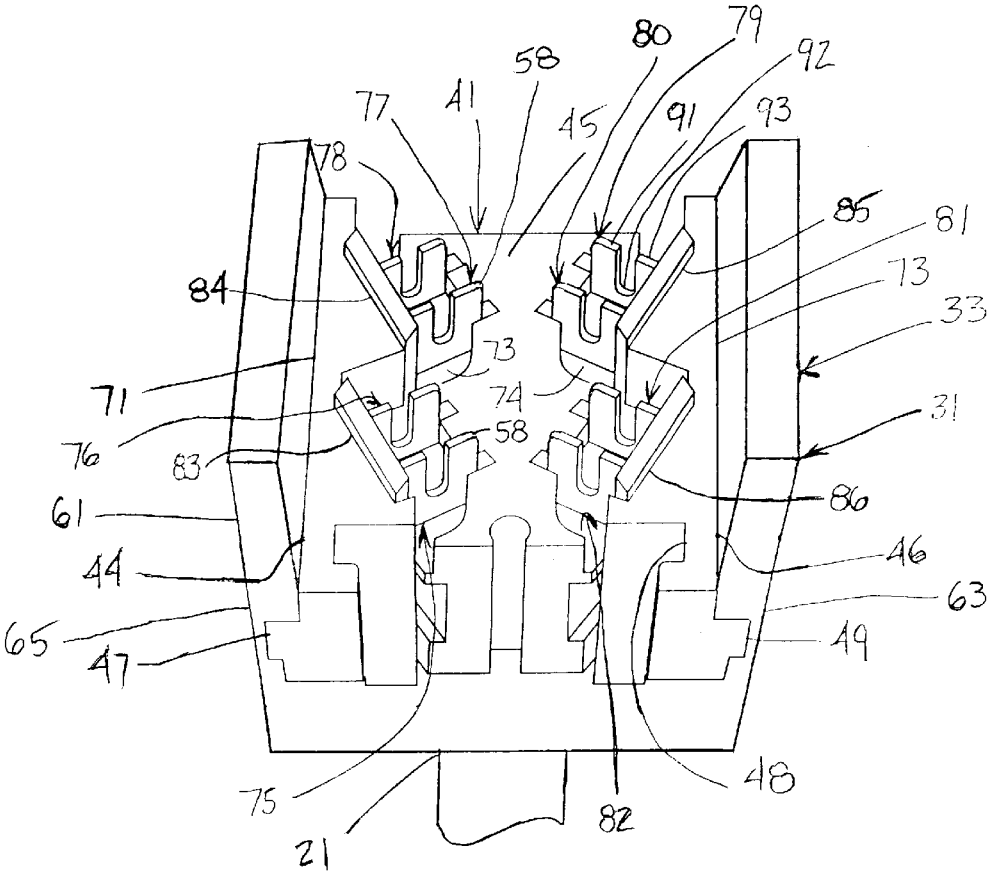
FIG. 5 is a perspective view of the base of the cable punch of FIG. 1, showing the bottom face of the base.
Figure 9:
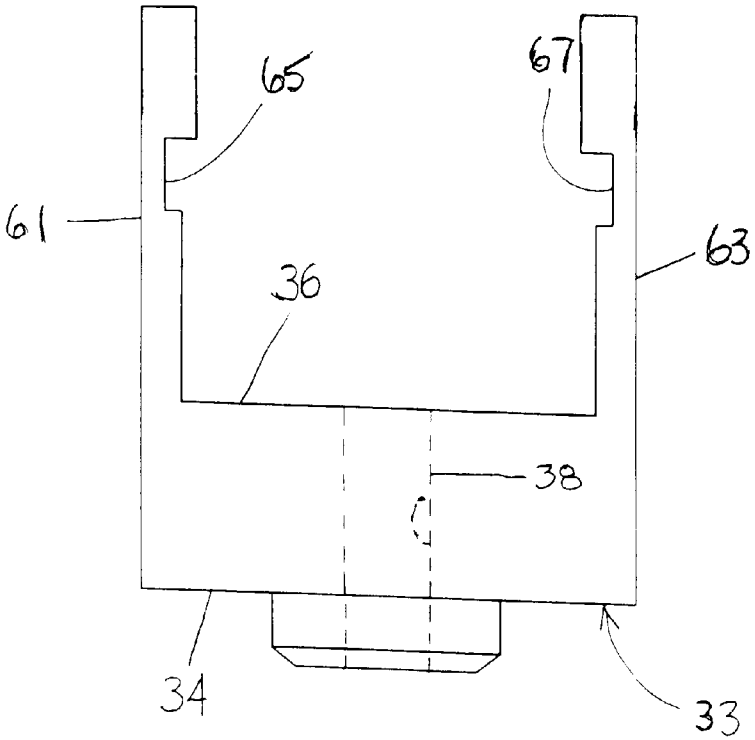
FIG. 9 is a front elevational view of the body of the base of FIG. 1.
Figure 11:
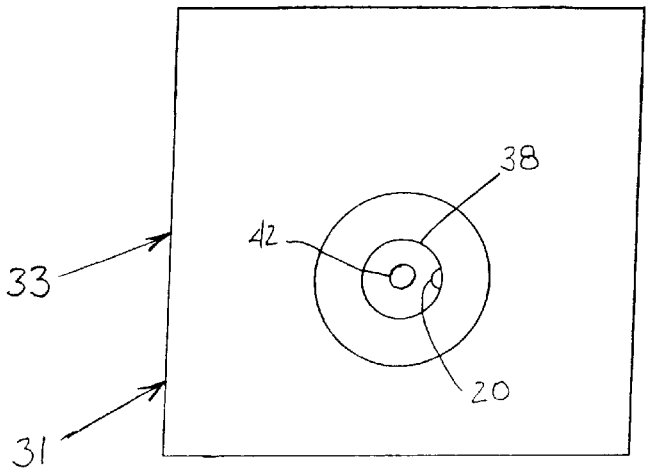
FIG. 11 is a top plan view of the base of FIG. 1.

As shown in FIG. 9, the body 33 of the base has a first face 34 and a second face 36. Preferably, the first face 34 is opposite the second face 36. A passageway 38 extends from the first face to the second face for receiving the rod 21. As shown in FIG. 11, a ball 20 is located in passageway 38 to facilitate retention of the base 31 on the rod 21. First and second arms 61 and 63 extend outwardly from second surface 36. Preferably, first and second arms 61 and 63 extend substantially perpendicularly from opposite edges of the second surface 36 of the body 33, as shown in FIG. 5. Preferably, arms 61 and 63 extend beyond insert 41 to protect all parts of the cable punch assembly during use, including insert 41, wire pusher members 91 and 93, blades 52, and first and second insert shoulders 47 and 49. First and second recesses 65 and 67 in the first and second arms 61 and 63, respectively, receive the insert 41. Preferably, body 33 is made of a metal.

Figure 3:
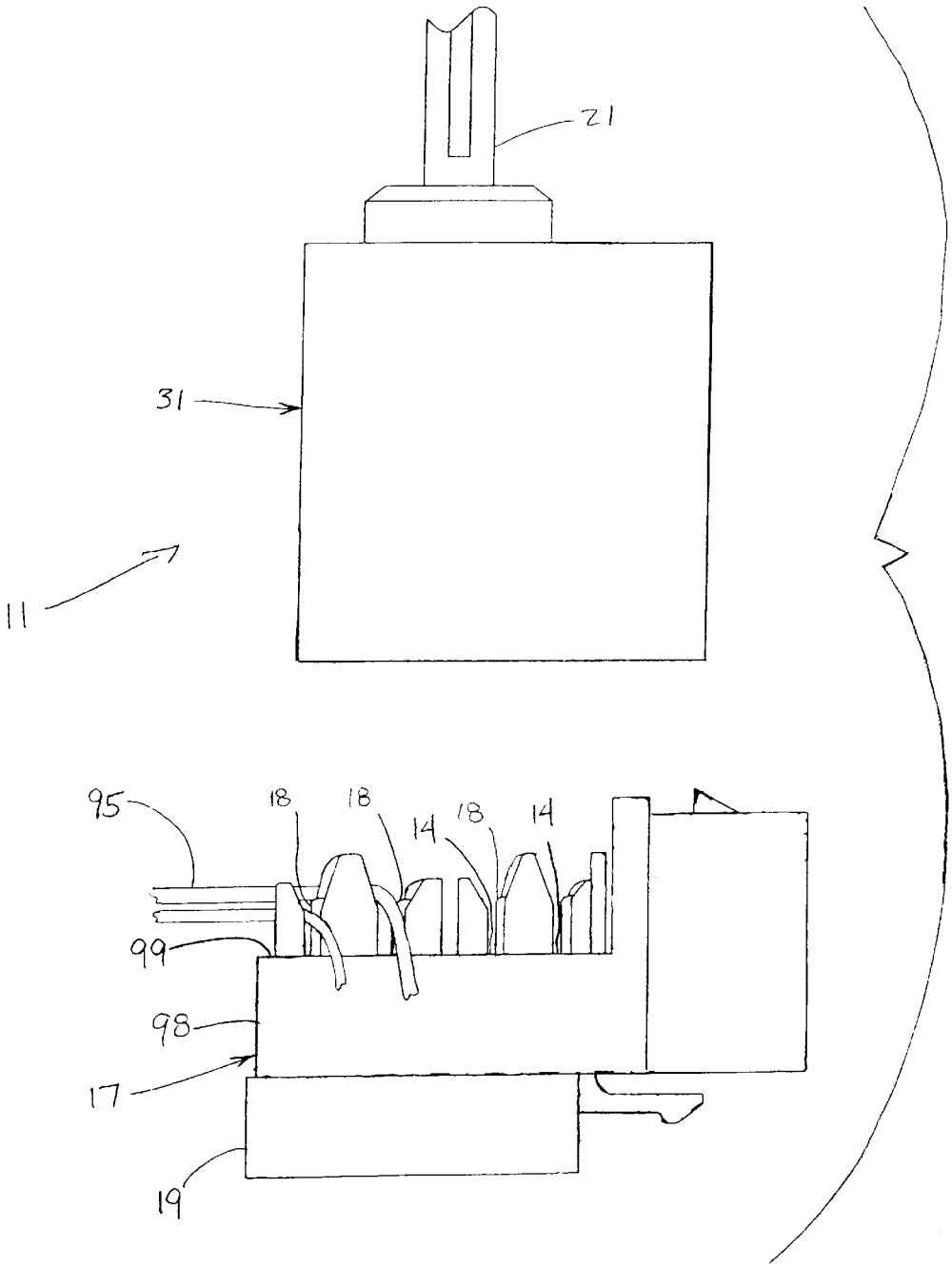
FIG. 3 is a side elevational view of the cable punch assembly of FIG. 1 receiving a plurality of wires prior to connecting the wires to a wiring unit.
Figure 7:
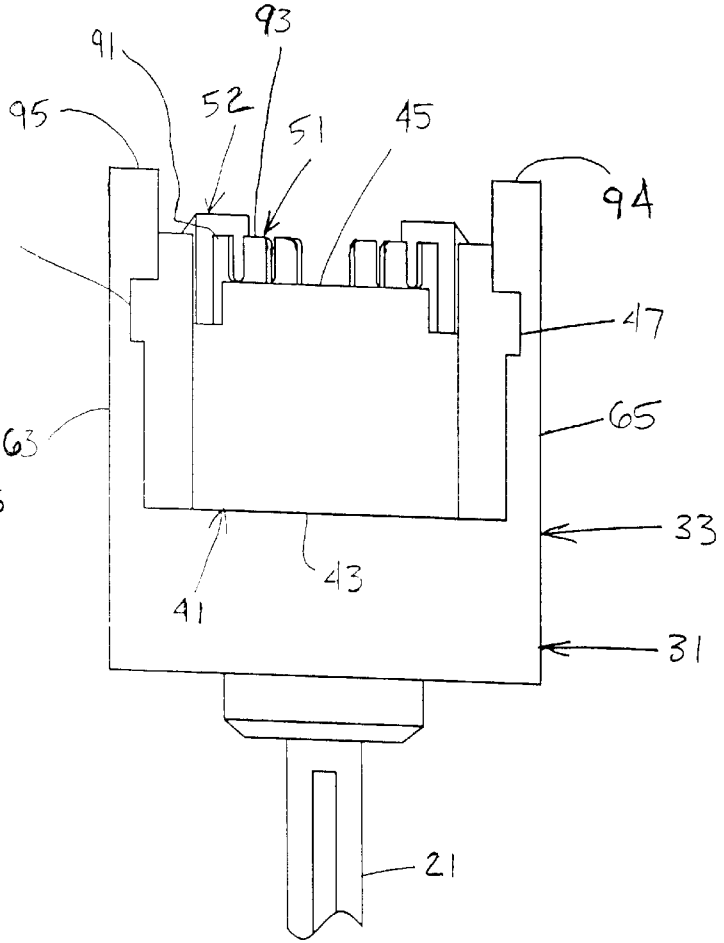
FIG. 7 is a rear elevational view of the base of FIG. 1.
Figure 10:
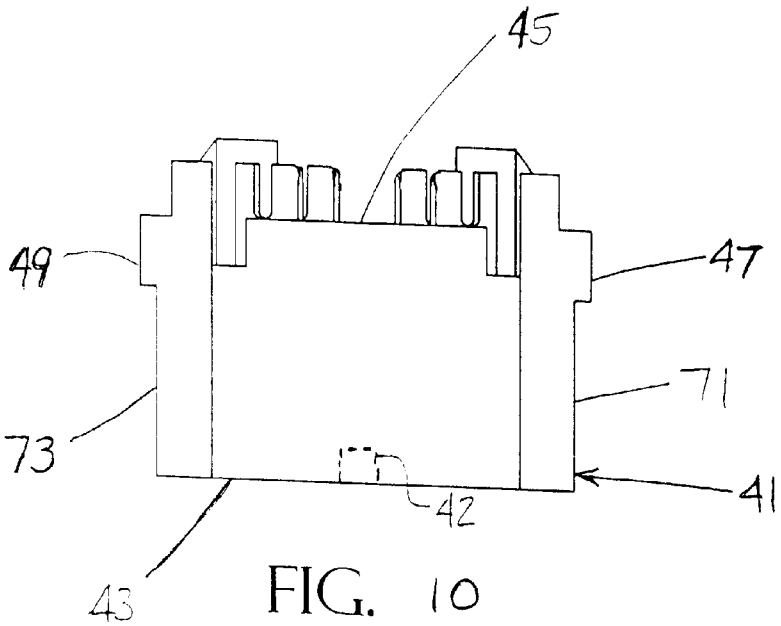
FIG. 10 is a rear elevational view of the insert of the base of FIG. 1.
Figure 12:
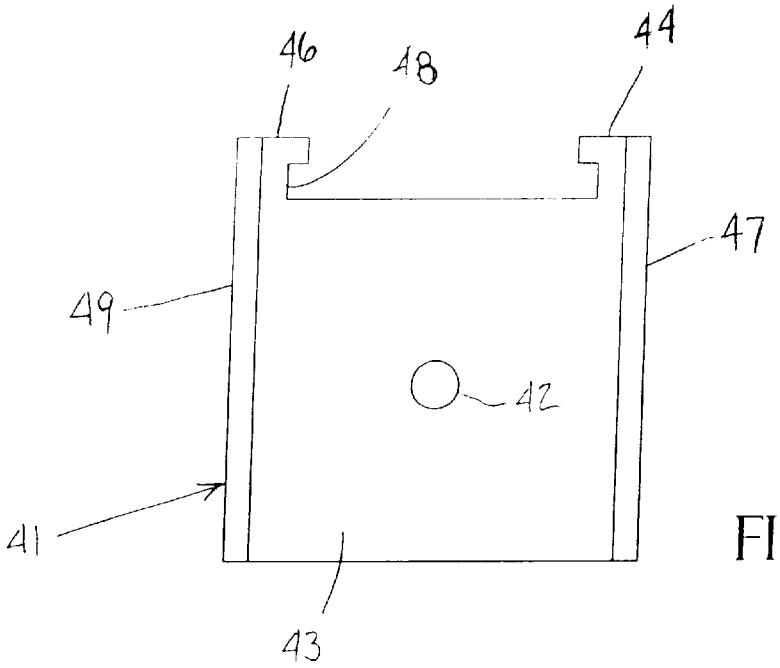
FIG. 12 is a top plan view of the insert of the base of FIG. 1 without the body.

As shown in FIGS. 5, 7 and 10, the insert 41 has first and second faces 43 and 45. Preferably, the first face 43 is opposite the second face 45. An opening 42 in first face 43 receives tip 29 of rod 21, as shown in FIG. 12. First and second arms 44 and 46 extend substantially perpendicularly from a third face 50 of insert 41. A groove 48 is formed between the first and second arms for receiving and aligning with a wiring unit, as shown in FIGS. 2, 3 and 7. First and second shoulders 47 and 49 extend along fourth and fifth faces 71 and 72, respectively, of the insert 41. Cavities 73 and 74 extend along second face 45 of the insert 41. Preferably, insert 41 is made of a plastic.

Figure 6:
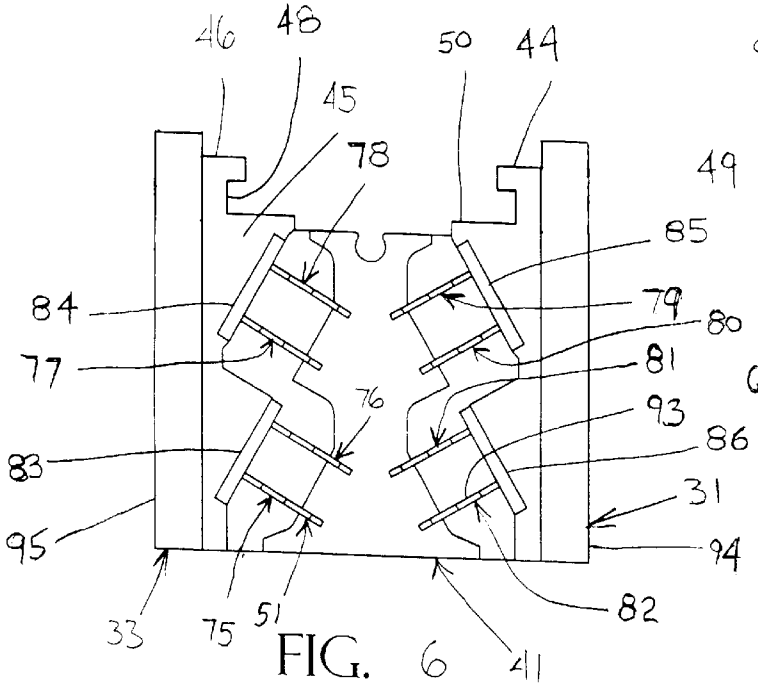
FIG. 6 is a bottom plan view of the base of FIG. 1.
Figure 8:
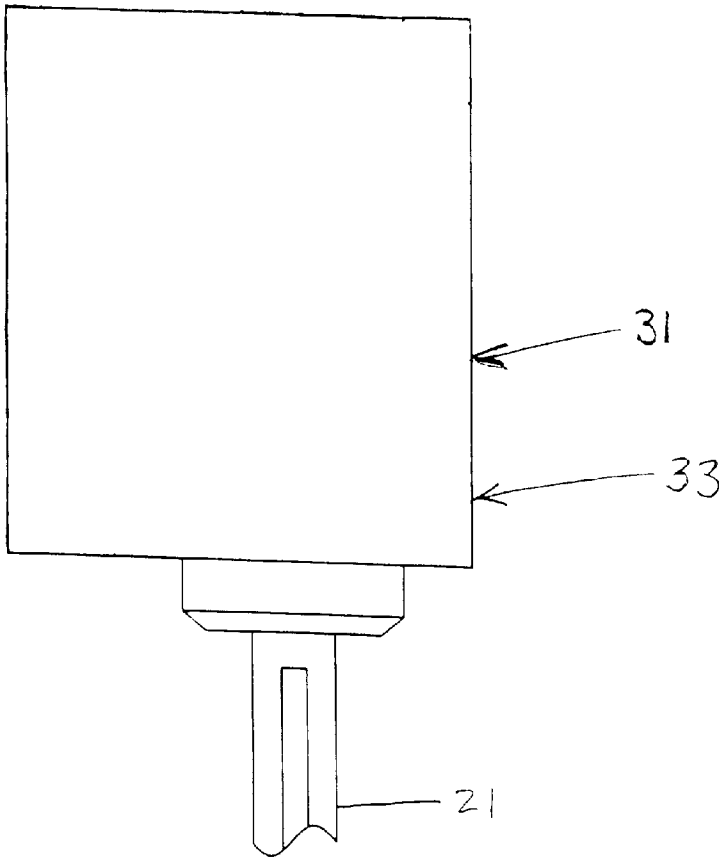
FIG. 8 is a side elevational view of the base of FIG. 1.

As shown in FIGS. 1–4, connectors 51 receive wires for connecting to insulation displacement contacts 18 of a wiring unit 17. The wiring unit 17, insulation displacement contacts 18, and stuffer cap 19 are described in U.S. Pat. No. 6,193,526 to Milner et al. and U.S. patent application Ser. No. 09/675,652 of Miller et al. First, second, third, fourth, fifth, sixth, seventh and eighth connectors 75, 76, 77, 78, 79, 80, 81 and 82, respectively, extend from second surface 45 of the insert 41. Preferably, four connectors 51 extend from each of first and second cavities 73 and 74 in the second face 45 of the insert 41. Preferably, each of the connectors 51 is non-perpendicular to any edge of the second face of the base 31 and insert 41, as shown in FIGS. 5–6.

Each connector 51 includes two laterally spaced wire pusher members 91 and 93 that extend axially from the base to receive an insulation displacement contact 18 between the pusher members as the pusher members force a wire into a wire receiving slot 14 of the contact 18. As shown in FIG. 5, inner most edge 58 of wire pusher member has a rounded edge 58 to prevent damaging wire with a sharp edge. Preferably, each connector 51 is substantially U-shaped, such that each wire pusher member 91 and 93 forms a leg with a slot 92 therebetween for receiving an insulation displacement contact.

A blade 52 may be positioned proximal each pair of connectors 51. First blade 83 is positioned proximal first and second connectors 75 and 76. Second blade 84 is positioned proximal third and fourth connectors 77 and 78. Third blade 85 is positioned proximal fifth and sixth connectors 79 and 80. Fourth blade 86 is positioned proximal seventh and eighth connectors 81 and 82. The blades 52 are positioned proximal each pair of connectors so that any excess wiring is cut by the blade, thereby forming a neatly wired wiring unit.

Assembly and Disassembly

As shown in FIG. 7, the insert 41 is received by the body 33 to form the base 31. First and second shoulders 47 and 49 are received by the first and second recesses 65 and 67 in the body 33. When properly inserted, the opening 42 in the first face 43 of the insert is aligned with the passageway 38 of the body 33. The rod 21 is then inserted through passageway 38 in the body 33 and into the insert 41. The tip 29 of rod 21 is received by the opening 42 in first face 43 of insert 41. Ball 20 in passageway 38 travels along axial groove 22 in the rod 21 as the rod passes through the body 33 and into the insert 41. When rod 21 is fully inserted, ball 20 is aligned with circumferential groove 32. The base 31 is then rotated approximately 90 degrees, so that the ball travels along circumferential groove 32 until coming to rest in recess 28 in rod 21, thereby locking insert 41 to body 33. The tip 29 of rod 21 prevents insert 41 from being slid horizontally out of the body. The upper ends 94 and 95 of arms 61 and 63 prevent insert 41 from being removed vertically from body 33.

To remove insert 41 from body 33, base 31 is rotated so that ball 20 of body 33 is in the axial groove 22. Base 31 may then be vertically slid from rod 21. Once base 31 has been removed from rod 21, insert 41 may be removed from body 33.

Figure 4:
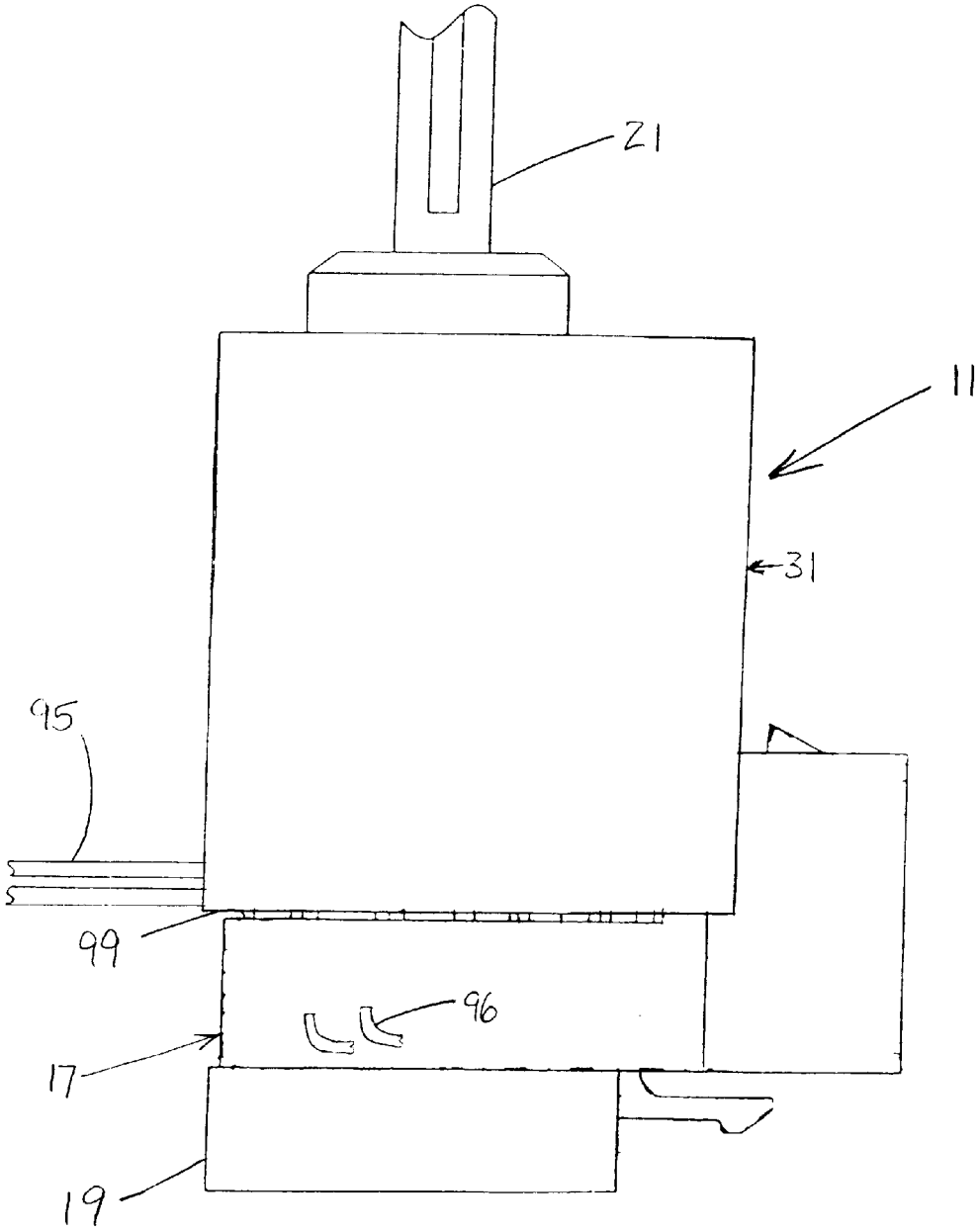
FIG. 4 is a side elevational view of the cable punch assembly of FIG. 1 connecting a plurality of wires to terminals of the wiring unit.

Once base 31 has been secured to rod 21, a wire 95 may be inserted in any of the slots 14 in the wiring unit 19. The wiring unit 19 shown in FIGS. 3 and 4 is a typical RJ plug having eight insulation displacement contacts, and, therefore, eight slots 14. Each slot 14 may receive a wire 95, thereby allowing up to eight wires to be terminated in wiring unit 19. A wire 95 is held in slot 14 of an insulation displacement contact. Wire 95 enters wiring unit 19 from first end 98. Wire 95 is then bent less than 90 degrees and positioned in any open slot 14 of wiring unit 19. Excess wire extends over the sides of wiring unit 19, as shown in FIG. 3. Once all the desired wires 95 have been inserted into slots 14 of insulation displacement contacts 18 of wiring unit 19, the cable punch assembly may be used to connect the wires to insulation displacement contacts 18 of wiring unit 19.

The cable punch assembly 11 is aligned with the wiring unit 17, such that groove 48 is aligned with shoulder 97 of the wiring unit. Once groove 48 of base 31 is aligned with shoulder 97 of the wiring unit, the base slides down so that wires 95 are pushed deep into slots 14 of insulation displacement contacts 18. Both wire pusher members 91 and 93 of connector 52 contact wire 95, and force the wire down into slot 14 of insulation displacement contact 18, such that when the cable punch assembly is pulled up the wires are kept behind by the insulation displacement contacts of the wiring unit 17. Slots 92 of connectors 52 receive insulation displacement contacts 18 as wire 95 is inserted into the insulation displacement contacts.

When wire pusher members 91 and 93 of cable punch assembly 11 have inserted wire 95 into insulation displacement contact 18, blades 52 contact surface 99 of wiring unit 17. Any excess wire 96 extending over the edge of wiring unit 17 is cut by the blade, as shown in FIG. 4, thereby providing a neatly wired wiring unit.

While advantageous embodiments have been chosen to illustrate the invention, it will be understood by those skilled in the art that various changes and modifications may be made therein without departing from the scope of the invention as defined in the appended claims.

What is claimed is:

1. A cable punch assembly for connecting a plurality of wires to plural insulation displacement contacts, comprising:

a rod having first and second ends;

a base including;

first and second opposite faces;

first and second arms extending from said second face;

a passageway extending from said first face to said second face for receiving said rod therethrough;

an insert received by said first and second arms, said insert having first and second opposite faces, said insert first face having an opening for receiving said rod second end;

eight connectors extending from said insert second face; and a blade extending from said insert second face proximal each of said connectors.

2. A cable punch assembly for connecting a plurality of wires to plural insulation displacement contacts according to claim 1, wherein a handle is connected to said second end of said rod.

3. A cable punch assembly for connecting a plurality of wires to plural insulation displacement contacts according to claim 1, wherein said arms extend substantially perpendicularly from said base second face.

4. A cable punch assembly for connecting a plurality of wires to plural insulation displacement contacts according to claim 1, wherein said base second face has first and second opposite edges, said first arm extending from said first edge and said second arm extending from said second edge.

5. A cable punch assembly for connecting a plurality of wires to plural insulation displacement contacts according to claim 1, wherein, wherein each of said connectors extends substantially perpendicularly from said insert second face.

6. A cable punch assembly for connecting a plurality of wires to plural insulation displacement contacts according to claim 1, wherein, wherein each of said connectors is substantially U-shaped.

7. A cable punch assembly for connecting a plurality of wires to plural insulation displacement contacts according to claim 1, wherein said insert is removably received by said first and second arms.

8. A cable punch assembly for connecting a plurality of wires to plural insulation displacement contacts according to claim 1, wherein the eight connectors are configured as four pairs of connectors and wherein said insert second face has first and second cavities, two of said four pairs of connectors extending from each of said first and second cavities.

9. A cable punch assembly for connecting a plurality of wires to plural insulation displacement contacts according to claim 1, wherein said insert has a groove to receive a member of and to align said insert with a wiring unit.

10. A cable punch assembly for connecting a plurality of wires to plural insulation displacement contacts according to claim 1, wherein each said connector is non-perpendicular to any edge of said insert second face.

11. A cable punch assembly for connecting a plurality of wires to plural insulation displacement contacts according to claim 1, wherein four of said connectors are in a first row and four of said connectors are in a second row.

12. A cable punch assembly for connecting a plurality of wires to plural insulation displacement contacts according to claim 1, wherein said connectors are arranged in pairs and wherein each said blade extends from said insert second face proximal each pair of said connectors.

* * * * *